United States Patent [19]

Gray

[11] 4,055,505

[45] * Oct. 25, 1977

[54] ACTIVATED PERCOMPOUND BLEACHING COMPOSITIONS

[75] Inventor: Frederick W. Gray, Summit, N.J.

[73] Assignee: Colgate-Palmolive Company, New York, N.Y.

[ * ] Notice: The portion of the term of this patent subsequent to Sept. 28, 1993, has been disclaimed.

[21] Appl. No.: 641,013

[22] Filed: Dec. 15, 1975

Related U.S. Application Data

[63] Continuation-in-part of Ser. No. 487,889, July 12, 1974, Pat. No. 3,982,892.

[51] Int. Cl.[2] ..... C11D 7/54; C11D 7/56

[52] U.S. Cl. ..... 252/102; 252/89 R; 252/99; 252/186; 252/526; 8/111; 252/94

[58] Field of Search ..... 252/94, 99, 89, 526, 252/186, 102; 8/111

[56] References Cited

U.S. PATENT DOCUMENTS

| | | | |
|---|---|---|---|
| 2,739,073 | 3/1936 | Bertorelli | 106/288 |
| 3,206,408 | 9/1965 | Vitalis | 252/557 |
| 3,755,180 | 8/1973 | Austin | 252/99 |
| 3,769,222 | 10/1973 | Yurko | 252/89 |
| 3,929,678 | 12/1975 | Laughlin et al. | 252/526 |

FOREIGN PATENT DOCUMENTS

| | | |
|---|---|---|
| 813,581 | 4/1975 | Belgium |
| 2,422,655 | 5/1974 | Germany |

*Primary Examiner*—Mayer Weinblatt

[57] ABSTRACT

An activated percompound bleaching composition comprises a bleaching percompound, such as sodium perborate tetrahydrate, an activator for such percompound, such as 2-[bis(2-hydroxyethyl)amino]-4,6-dichloro-s-triazine and a molecular sieve zeolite, such as hydrated type 4A synthetic molecular sieve zeolite. In a preferred embodiment of the invention a mixture of the described activator and diacetyl dimethylglyoxime activator is employed and inorganic builder, salts such as sodium carbonate and sodium silicate, are present, together with inorganic filler salt, such as sodium sulfate. Also within the invention are detergent compositions containing the mentioned bleaching composition components with a synthetic organic detergent, such as sodium higher linear alkylbenzene sulfonate. Methods of bleaching and washing and bleaching with the described compositions are disclosed.

22 Claims, No Drawings

ACTIVATED PERCOMPOUND BLEACHING COMPOSITIONS

This application is a continuation-in-part of my U.S. patent application Ser. No. 487,889 for Activated Peroxy Bleach Composition, filed July 12, 1974, now U.S. Pat. No. 3,982,892.

This application relates to activated percompound bleaching compositions useful for bleaching of fibrous organic materials, such as textiles and laundry. More particularly, it relates to such compositions which include a percompound, such as sodium perborate or sodium percarbonate, an activator for such percompound of the triazine type, such as a 2-[di-(2-hydroxy-lower alkyl)amino]-4,6-dihalo-s-triazine or 2,4-di-lower alkoxy-6-halo-s-triazine or a mixture thereof, preferably with an auxiliary activator or mixture thereof present, and a synthetic molecular sieve zeolite. Also within the invention are bleaching detergent compositions containing said bleaching components and methods of bleaching with the mentioned compositions.

As was mentioned in my above-identified patent application, which is incorporated by reference herein, it has been known to utilize percompounds in the bleaching of fabrics to remove stains from them. The percompounds, in aqueous solution, usually at elevated temperature, release active oxygen which oxidizes the stain and converts it to a colorless material or to a compound or a plurality of compounds which is/are more readily removable from the fabric substrate by the medium or by a detergent composition. Sodium perborate is the most widely used of such percompounds at present and at a concentration of one gram of sodium perborate per liter in water it yields about 100 parts per million of active oxygen. The tetrahydrate, $NaBO_2.H_2O_2.3H_2O$, is the most usual commercial form of sodium perborate and in this specification when sodium perborate is referred to the tetrahydrate is intended or an equivalent weight (on the basis of active oxygen released) of anhydrous perborate, other percompound (if the contex so indicates) or other hydrate. While sodium perborate tetrahydrate is about 10% of active oxygen, the sodium percarbonate of commerce, $2Na_2CO_3.3H_2O_2$, usually contains about 12 to 14% of active oxygen. Other percompounds which may be used in place of the mentioned perborate and percarbonate, such as sodium peroxypyrophosphate and sodium peroxysilicate and other alkali metal perborates, percarbonates, peroxypyrophosphates and peroxysilicates, will normally be employed in weights sufficient to produce equivalent proportions of active oxygen when they are substituted for the mentioned perborate and/or percarbonate.

In Europe bleaches and detergents often include sodium perborate and because in many of the methods employed there laundry is bleached and washed at elevated temperatures, often near the boil, e.g., 85° to 100° C., preferably 90° to 99° C., good active oxygen release from perborate is obtained (because such release is faster at higher temperature). In the United States and in many countries and to some extent as a new practice in Europe, neither bleaching nor laundering is conducted at such high temperatures. In fact, often home hot water supplies produce water at a temperature of 60° C. or less, sometimes as low as 45° C.. Furthermore, modern synthetic polymeric fabric materials treated with permanent press or wrinkle-resistant finishes usually should not be heated to high temperatures during any bleaching operations and many dyestuffs are all too readily removed from fabric substrates at such temperatures, which also can cause shrinking or undesirable distortions of the substrates. Additionally, for energy conservation high water temperatures should be avoided. For these reasons, among others, it is desirable to wash and bleach in cold and warm waters.

In an effort to facilitate bleaching with percompounds at temperatures lower than 80° C., preferably at temperatures lower than 65° C., various activators have been suggested which regulate the release of active oxygen from the percompounds, usually by increasing the speed of release and promoting such release at lower temperatures. Among such compounds are certain triazine derivatives, such as 2-[bis(2-hydroxyethyl)-amino]-4,6-dichloro-s-triazine, hereafter coded BHADT, and 2,4-dimethoxy-6-chloro-s-triazine, hereafter called DCT. Preferably, as taught in my parent application, such activators are employed with other known activators, such as diacetyl dimethyl glyoxime, hereinafter referred to as DDG and tetraacetyl glycoluril, hereinafter called as TAG. The latter two activators, while useful to improve the release of active oxygen from percompounds, especially sodium perborate, are not usually sufficiently effective to speed release of active oxygen from percompounds at a satisfactory rate in cold and warm water (15° C. to 60° C.) and do not produce active oxygen to the extent that it is released from sodium perborate at the boil, as in the European method of bleaching and washing. However, the combination of such an "acyl" activator with a "triazine" activator, the latter often being otherwise too active for some applications, results in a satisfactory, yet safe, percompound bleach, as taught in my previous application.

Recently, molecular sieve zeolites, such as hydrated type A synthetic molecular sieve zeolites, have been utilized in detergent compositions as insoluble builders for active detersive ingredients. The disclosed building zeolites are considered to be environmentally preferable to phosphates, carbonates and other soluble inorganic builder salts and it has been suggested that therefore they should be incorporated in detergent compositions containing perborates. However, they have not previously been disclosed with triazine activators such as those of the present invention and the desirable results from such combinations have not been previously reported.

In the present bleaching compositions and methods the molecular sieve zeolite, preferably in hydrated form, yet normally still further hydratable, aids in stabilizing the normally highly active triazine activators and the percompound in its presence, helps to tie up any alkaline earth metal and heavy metal ions which might otherwise tend to decompose the percompound in the presence of the activator on storage, physically insulates the percompound from the triazone activator or activator mixture to a useful extent and thereby promotes stability of storage and facilitates the production of a non-tacky, non-caking and free-flowing powdered bleach or bleaching detergent composition. In the bleaching detergent, which also contains a synthetic organic detergent, the molecular sieve zeolite helps to prevent any undesired oxidation of the synthetic organic detergent during storage before use, due to its dehydrating, sequestering and insulating action, which limits contact of the detergent particles with the percompound-activator mixture. During use the molecular sieve zeolite serves to adsorb any unbleached dyes that may be released from the fibers and fabrics of colored textiles and laundry, thereby preventing discoloration of such fabrics by any "running" dyes that might adhere, usually selectively, to other fabrics. Thus, the presence of the synthetic molecular sieve zeolite in bleaching and bleaching detergent compositions containing a percompound and a triazine activator helps to produce a more stable and more effective bleaching product.

In accordance with the present invention an activated percompound bleaching composition comprises a bleaching percompound, an activator for such percompound which, in aqueous bleaching solution, activates the percompound to promote bleaching by it, said activator being selected from the group consisting of 2-[di-(2-hydroxy-lower alkyl)amino]-4,6-dihalo-s-triazine, 2,4-di-lower alkoxy-6-halo-s-triazine and mixtures thereof, and a molecular sieve zeolite. Very preferably, in such compositions there will also be present an acyl activator, such as di-lower alkanoyl di-lower alkyl glyoxime, tetra-lower alkanoyl glycoluril or a mixture thereof. In bleaching detergent compositions such materials will be present with a synthetic organic detergent, such as an anionic or nonionic detergent. Also within the invention are methods of bleaching or washing and bleaching with such compositions.

The peroxy bleaching compounds are inorganic materials, preferably salts, such as metal salts, more preferably alkali metal or alkaline earth metal salts and most preferably the sodium (and potassium) salts of inorganic peracids, of which sodium perborate and sodium percarbonate are most preferable. When a perborate is employed the tetrahydrate is preferred but the monohydrate and other hydrated forms are also useful. Similarly, equivalent amounts of other oxygen-releasing percompounds and their hydrates may be used. Sodium peroxypyrophosphate and sodium peroxysilicate are also useful and other suitable peroxy materials or percompounds, especially salts, e.g., alkali metal salts, may also be employed, at least in part, under suitable conditions, such as sodium persulfate and sodium peroxide. In general the preferred percompounds to be activated are those which contain hydrogen peroxide within their structure and which are generally inorganic. However, these may sometimes be organic, such as, for example, urea peroxides. Inorganic percompounds are disclosed in U.S. Pat. No. 3,532,634 (Woods), the disclosure of which is incorporated herein by reference. As was previously mentioned with respect to peroxy type compounds the relative amounts or proportions of the peroxy materials employed will usually be such as are equivalent in active oxygen released to the taught amounts or proportions of the perborates. The percompounds used, preferably the perborate or percarbonate, will normally be in finely divided powdered form, preferably of particle sizes in the 37 to 250 micron diameter range, e.g., in the range of 44 to 149 microns, but sizes larger than 250 microns, sometimes up to 2 or 2.5 millimeters, may be employed. Because of their usual instabilities at high temperatures normally the percompounds and the activators for them will not be spray dried with other bleaching composition constituents but will be blended with them and may be size reduced in mixture with them.

The triazine type or triazine derivative activators, which are usually capable of forming hydroperoxides, are preferably selected from the group consisting of 2-[di-(2-hydroxy-lower alkyl)amino]-4,6-dihalo-s-triazines and 2,4-di-lower alkoxy-6-halo-s-triazines and mixtures thereof. The hydroperoxide-forming triazine compounds of the 2-[di(2-hydroxy-lower alkyl)amino]-4,6-dihalo-s-triazine structure will normally be those wherein the lower alkyls (actually alkylenes) are of 1 to 5 carbon atoms, preferably 1 to 3 carbon atoms and the halogens are either chlorine atoms or bromine atoms or mixtures thereof, preferably all being chlorine. The alkyls of the hydroxyalkyl groups may be different but normally are the same and the halogens may be different but normally will also be the same. The 2,4-di-lower alkoxy-6-halo-s-triazine compounds will usually have the lower alkoxy groups of 1 to 4 carbon atoms, preferably of 1 to 2 carbon atoms and the halogens will normally be chlorine or bromine or mixtures thereof, preferably all chlorine. The alkoxies will usually preferably be methyl but sometimes ethyl may be preferred. Generally, the alkoxies and the halogens will be the same but they may be different too, within the descriptions given. Mixtures of the triazine derivatives of the type resembling BHADT may be made with those of the type resembling DCT and mixtures within each type group may also be made.

The activators of the acyl activator class are preferably compounds selected from the group consisting of di-lower alkanoyl di-lower alkyl glyoximes and tetra-lower alkanoyl glycolurils and mixtures thereof. With respect to the di-lower alkanoyl di-lower alkyl glyoximes, the alkanoyls are usually of 2 to 5 carbon atoms, with 2 to 3 carbon atoms being preferred, and normally will be the same, although they may be independently selected. Similarly, the alkyl groups, including the alkyls of hydroxyalkyl and alkoxy, may be independently selected but will normally be the same and will generally be of 1 to 4 carbon atoms, with 1 to 2 carbon atoms being preferred. The tetra-lower alkanoyl glycolurils also have alkanoyl substituents of 2 to 5 carbon atoms, with those of 2 to 3 carbon atoms being preferred and with it generally being preferred to have all four alkanoyl groups the same, although they may also be independently selected. Mixtures of the mentioned compounds of the glyoxime and glycoluril derivatives types may be employed, as may be mixtures of individual compounds of each type. Although it is highly preferred to utilize a mixture of triazine and acyl type activators, this invention is still useful and practicable when only a triazine activator is present but is normally not satisfactory when only an acyl type activator is present.

Although the preferred triazine and acyl activators are described above, in a broader sense the present invention also relates to improving the activation of the peroxy bleach compounds or bleaching percompounds with a molecular sieve zeolite and a hydroperoxide-forming triazine activator (or mixture) and/or a mixture of hydroperoxide-forming triazine activator and peracid-generating acyl activator. The words "peracid-generating" and "hydroperoxide-forming" are intended to encompass compounds functioning like those previously described as examples of such classes. For example, among such other acyl activators, which preferably produce percarboxylic acids (or salts), e.g., peracetic acid, are: benzoic anhydride; tetraacetylethylenediamine; N-acetyldimethylhydantoin; N-acetyl-1-phenylhydantoin; ESPC [ethyl sulfophenyl carbonate or salt thereof (the sodium salt is preferred)]; T A C A; C S A; S A B S; chlorobenzoic anhydride; p-acetoxybenzoic acid; and various other such compounds of the anhydride ester, acyl halide, acyl cyanurate and acyl amide classes, such as are described by Gilbert in a series of articles appearing in *Detergent Age,* June 1967, pages 18–20; July 1967, pages 30–33; and August 1967, pages 26, 27 and 67; by Wood in U.S. Pat. No. 3,532,634; and by Gray in U.S. Pat. No. 3,637,339; all of which are hereby incorporated herein by reference. The Gilbert references include descriptions of the abbreviated names of some of the activators. Also incorporated by reference is the disclosure of the Loffelman et al. U.S. Pat. No. 3,775,333 for its disclosure of N-acyl azoline acyl activators and the use of mixtures of such activators. With respect to both the hydroperoxide-forming triazine activators and the acyl activators, which latter are preferably materials which yield peracetic acid for peroxy compound activation, instead of aliphatic substituents such as the alkyl and alkanoyl groups it may sometimes be desirable to employ aromatic substitution. Thus, benzoyl radicals may be the acyl radicals of the activators described above and phenyl groups may substitute for the alkyls. Generally, however, it is preferred to utilize aliphatic substitution.

With respect to the triazine compounds, these are of the formula

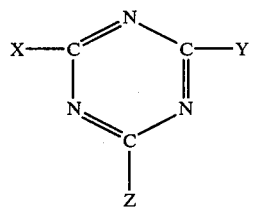

wherein X is halogen (Cl or Br); Z is a substituent group (N-anilino; N-di-lower alkanol; N-lower alkanol-lower alkyl; -O-lower alkyl; -lower alkanol; N-dilower alkyl; N-lower alkyl, lower alkanol and combinations thereof); and Y is either X or Z or a mixture thereof. Although the alkyls are preferably of 1 to 4 carbons they may be of up to 12 carbons, too and aromatic substitutents may be present in some cases. In addition to the compounds previously described as representative of the "triazine" activators there may also be used those of the formula given wherein: (1) X is chlorine, Y is chlorine and Z is methoxy; (2) X is chlorine, Y is chlorine and Z is $—NHCH_3$; (3) X is chlorine, Y is chlorine and Z is $—N(C_2H_5)_2$; and (4) X is chlorine, Y is $—NHCH_3$ and Z is $—NHCH_3$. Instead of chlorine, bromine may be substituted. Such compounds are described in Swedish patent application No. 73 10 334-3 filed July 25, 1973 by Mitsubishi GAF Chemical Co., Inc. for A Method of Bleaching, claiming priority of Japanese application No. 75537 filed July 29, 1972, both hereby incorporated by reference.

The molecular sieves utilized in making the invented bleaching composition are water insoluble crystalline aluminosilicate zeolites of natural or synthetic origin which are characterized by having a network of uniformly sized pores in the range of about 3 to 10 Angstroms, preferably about 4 A (nominal), which size is uniquely determined by the unit structure of the zeolite crystal. Of course, zeolites containing two or more such networks of different size pores can also be employed.

The molecular sieve zeolite should also be a univalent cation-exchanging zeolite, i.e., it should be an aluminosilicate containing a univalent cation such as sodium, potassium or lithium, when particable or of ammonium or hydrogen. Preferably, the univalent cation associated with the zeolite molecular sieve in an alkali metal cation, especially sodium or potassium, most preferably sodium.

Crystalline types of zeolites utilizable as molecular sieves in the invention, at least in part, include zeolites of the following crystal structure groups: A, X, Y, L, mordenite and erionite. Mixtures of such molecular sieve zeolites can also be useful, especially when type A zeolite, e.g., type 4A, is present. These preferred crystalline types of zeolites are well known in the art and are more particularly described in the text, *Zeolite Molecular Sieves,* by Donald W. Breck, published in 1974 by John Wiley & Sons. Typical commercially available zeolites of the aforementioned structural types are listed in Table 9.6 at pages 747–749 of the Breck text, which table is incorporated herein by reference.

Preferably the molecular sieve zeolite used in the invention is a synthetic molecular sieve zeolite. It is also preferable that it be of type A crystalline structure, more particularly described at page 133 of the aforementioned text. Especially good results are generally obtained in accordance with the invention when a type 4A molecular sieve zeolite is employed, wherein the univalent cation of the zeolite is sodium and the pore size of the zeolite is about 4 Angstroms. The especially preferred zeolite molecular sieves are described in U.S. Pat. No. 2,882,243 which refers to them as Zeolite A.

Molecular sieve zeolites can be prepared in either a dehydrated or calcined form, the latter form containing from less than about 1.5% to about 3% of moisture, or in a hydrated or water loaded form which contains additional adsorbed water in an amount up to about 30 to 36% of the zeolite total weight, depending on the type of zeolite used. Preferably, water-containing partially hydrated forms of the molecular sieve zeolite are employed in the practice of this invention and these usually have a water content of 20 to 28.5%, e.g., 20 to 22%. The manufacture of such crystals is well known in the art. For example, in the preparation of Zeolite A, referred to above, the partially hydrated or hydrated zeolite crystals that are formed in the crystallization medium (such as a hydrous amorphous sodium aluminosilicate gel) are made without the high temperature dehydration (calcining to 3% or less water content) that is normally practiced in preparing such crystals for use as catalysts, e.g., cracking catalysts. The preferred form of zeolite in partially hydrated form can be recovered by filtering off the crystals from the crystallization medium and drying them in air at ambient temperature to such an extent that the water content thereof is as desired.

Usually the molecular sieve zeolite should be in finely divided condition such as crystals (amorphous or poorly crystalline particles may also find some use) having mean particle diameters in the range of about 0.5 to about 12 microns, preferably 5 to 9 microns and especially about 5.9 to 8.3 microns, e.g., 6.4 to 8.3 microns.

The bleeching compositions of this invention may be used directly for bleaching purposes or, as is often preferable, may be included in detergent compositions for bleaching, water softening and antimicrobial effects. Also, they may be utilized in fabric softening preparations, presoak compositions for treatment of laundry before washing, commercial bleaching compositions for bleaching raw fibers, stain removing products, bleaching scouring cleansers, denture cleansers and sterilizing or antimicrobial compositions. However, of these applications, it is preferable to utilize the activated peroxy compound bleaching compositions in detergent products or alone, as bleaches.

When in addition to the percompound, activator and molecular sieve zeolite there is also present a synthetic organic detergent, a bleaching detergent composition is produced, which is useful in cleaning and whitening laundry, especially laundry containing normal hard to remove (by washing only) stains, such as tea, coffee, wine, dye, ink, chocolate and fruit juice stains. The detergent utilized, a synthetic surface active agent having detersive properties, normally referred to as a synthetic organic detergent, in this specification includes higher fatty acid soaps, which are in the class of anionic synthetic organic detergents. The anionic detergents will normally have from 8 to 26, preferably from 12 to 22 carbon atoms per molecular and usually will include an alkyl or aliphatic chain containing about 8 to 18 carbon atoms, preferably from 10 to 16 carbon atoms in a straight chain alkyl group. The most preferred of such detergents are the alkali metal higher alkylbenzene sulfonates, such as the sodium and potassium salts, in which the higher alkyl groups are of 10 to 18 carbon atoms, preferably 12 to 14 carbon atoms and preferably also are linear. Other such anionic detergents include the alphaolefin sulfonates, paraffin sulfonates, ethoxylated alcohol sulfates, alkyl sulfates and sulfated higher alkyl phenyl polyoxyethylene ethanols, all preferably as alkali metal salts, such as the sodium salts. A list of such detergents is found in U.S. Pat. No. 3,637,339.

Nonionic detergent compounds may also be employed, often in admixture with an anionic detergent. Such compounds will normally be lower alkylene oxide condensation products, such as polyethylene oxides, which may sometimes have polypropylene oxide present but only to such an extent that the product is still water soluble. Preferred examples of such materials are the higher fatty alcohol-polyethylene oxide condensates wherein the higher fatty alcohol is of 10 to 18 carbon atoms, preferably 12 to 15 carbon atoms and the ethylene oxide portion thereof is a chain of 6 to 30 ethylene oxide units, preferably 7 to 15 ethylene oxide units and more preferably about 10 to 15 ethylene oxide units. Also useful are similar ethylene oxide condensates of phenols, such as nonyl phenol or isooctyl phenol but these are not preferred.

In addition, to the anionic and nonionic detergent compounds, both of which are preferable constituents of detergent compositions containing the present activated bleaching compositions, especially in mixture, there may also be employed amphoteric and cationic detergents. The amphoteric detergents are those containing both anionic and cationic solubilizing groups and a hydrophobic organic group, which is advantageously a higher aliphatic radical containing about 10 to 20 carbon atoms. Examples of such products include the N-alkyl betaamino-lower alkanoic acids, the N,N-dilower alkylglycines, the fatty imidazolines and the betaines. The cationic detergents are usually those which contain 1 or 2 higher molecular weight substituents and 2 or 3 lower molecular weight substituents on a positively charged ammonium nucleus which also has a halide ion, preferably a chloride or bromide. The higher weight or long chain substituents are usually of 8 to 18 carbon atoms and preferably are lauryl, myristyl or stearyl, with stearyl being most preferred. The lower weight short chain substituents are preferably lower alkyl, such as alkyl of 1 to 4 carbon atoms, e.g., methyl. Exemplary of the cationic detergents are distearyl dimethyl ammonium chloride, cetyl trimethyl ammonium bromide, benzyl dimethylstearyl ammonium chloride and dimethyl propylmyristyl ammonium chloride and the corresponding bromides or chlorides.

Although the non-built detergent compositions intended for light duty uses, such as dishwashing, sterilization, fabric softening and cleaning of delicate materials, may be made without builder salts, normally such salts are incorporated in presoak compositions, heavy duty detergent products, denture cleansers and scouring powders. Preferable builder salts are the alkali metal salts, more preferably the sodium and potassium salts of inorganic acids, e.g., borax, pentasodium tripolyphosphate, tetrasodium pyrophosphate (borax and phosphates may be omitted for ecological reasons), sodium silicates, preferably of $Na_2O:SiO_2$ ratios of 1:1.6 to 1:2.6, e.g., 1:2.4, sodium carbonate and potassium bicarbonate. Inorganic builders are preferred but organic builders are also useful, e.g., trisodium nitrilotriacetate, sodium citrate, potassium gluconate, and hydroxyethyl iminodiacetate, disodium salt. With the builder salts there may often be employed filler salts, such as alkali metal halides and sulfates, e.g., sodium chloride, sodium sulfate. Builders and fillers may also be parts of bleaching compositions, in which detergents are either not present or are present in small quantity, e.g., less than 3%.

In the detergent compositions there may also be present enzymes for assisting in breaking down the molecular structures of various stains and thereby helping to remove them from the substrates to which they are attached. Such enzymes are usually proteolytic enzymes, e.g., protease (sold under the trademark Alcalase®) but also useful are amylotic and other enzymes, e.g., amylase. Various other components may be present in the detergent and bleaching compositions, including soil suspending agents, anti-redeposition agents, hydrotropes, wetting agents, flow-improving agents, sequestrants, bactericides, fluorescent brighteners, stabilizers, fillers, coating agents, fungicides, emollients, perfumes, colorants and solvents. Also, various components of the composition may be coated or encapsulated to prevent interaction thereof with other composition ingredients. Thus, for example, the activators and/or precompound bleach materials may be coated or encapsulated with water-dispersible polyethylene glycol solids (Carbowax®), polyvinyl alcohol, paraffinic waxes, vegetable waxes, monoglycerides and other suitable protective coverings. Furthermore, the protective coatings for the activators and precompound bleach materials may include dextrin, dextrin containing a dispersing aid, such as sodium lauryl sulfate, plasticized dextrin, carboxymethyl starch, sodium carboxymethyl cellulose, potato flour or other suitable material, as described in Netherlands patent application No. 73/07820, filed by Henkel & Cie. GmbH on June 5, 1973 and Swedish patent application No. 72/005711, filed by Unilever N.V. on Apr. 28, 1972, both of which are incorporated herein by reference. The coatings may be applied by pan-mixing, spraying, solvent application and various other means known to the art and by methods described in the aforementioned applications. Such methods will also increase particle sizes, often to the range given for spray dried detergent-builder component beads.

More extended descriptions of the various ingredients of the present detergent compositions and other preparations including the activated bleach compositions of this invention are found in my U.S. Pat. Nos. 3,637,339; 3,640,874; 3,655,567; and 3,714,050, the disclosures of which are incorporated herein by reference. Also included by reference are the descriptions of the various synthetic organic detergents enzymes, adjuvants, bleaches and activators described in those patents and the proportions mentioned and conditions under which such materials are employed, together with methods for manufacturing them and various components thereof.

Additional descriptions of the detergents that are useful and accompanying builders, adjuvants, etc., are found in the text *Surface Active Agents and Detergents,* Vol. II, by Schwartz, Perry and Berch, published in 1958 by Interscience Publishers, Inc., especially at pages 25–138, and in *Detergents and Emulsifiers,* 1969–1973 Annuals, by John W. McCutcheon.

In preferred bleaching compositions wherein there is present a mixture of triazine derivative and acyl derivative activators for a percompound, preferably for sodium perborate tetrahydrate, the ratio of such activators (mixtures of each type may be used) is normally in the range of 1:4 to 4:1, more preferably 1:2 to 2:1 and most preferably about 1:1. The preferred acyl activator is diacetyl dimethyl glyoxime although tetraacetyl glycoluril may also be very satisfactorily employed. Normally, from 0.1 to 1.5 parts of activator of the triazine type, as previously described, are employed per part of percompound, e.g., sodium perborate tetrahydrate with preferred proportions being 0.3 to 1.2 : 1. The ratio of molecular sieve zeolite or mixture of zeolites, preferably type 4A partially hydrated molecular sieve zeolite, to percompound will usually be from 0.2 to 10, preferably 2 to 6. Percentages of the percompound, activator(s) and molecular sieve zeolite(s) may be varied over a substantial range but normally the percentages of the bleaching percompound and the zeolite will each be within the range of 5 to 75%, preferably with the percentage of percompound being from 7 to 50% and that of zeolite being from 20 to 60%. Percents activators are 0.5 to 15 and 3 to 15. In many bleach compositions, to adjust the pH to a desirable range and to tie up hardness and heavy metal ions in the water employed there will be present an alkaline metal salt, such as a builder salt, many of which were previously described. The proporation thereof will usually be in the range of from 5 to 50% and preferably will be from 5 to 25%. For ecological reasons it is often desirable for phosphates to be omitted from present bleach compositions although where no eutrophication problems exist they may be employed. Where phosphorus-containing compounds are omitted from the bleach it will often be desirable to utilize from 5 to 25% of an alkali metal carbonate, such as sodium carbonate, often with 1 to 15% of sodium silicate, e.g., about 5 to 10% of sodium silicate of $Na_2O:SiO_2$ ratio of about 1:2.35. In addition to the builder salts, filler salts, such as sodium sulfate and sodium chloride, may also be present, preferably in quantity within the range of 5 to 50%. The most preferable filler salt is sodium sulfate, normally employed in its anhydrous form, although hydrated or partly hydrated crystals may also be utilized. In another embodiment of the present invention, a bleaching detergent composition which includes a synthetic organic detergent, such as previously described, the bleaching composition components of the invention are the same and in addition there is present a synthetic organic detergent or detergent mixture, normally in a proportion, with respect to one part of the percompound, of 0.1 to 2, preferably 0.2:1. This will normally constitute from 5 to 40%, preferably 10 to 25% of the bleaching detergent composition, in which the bleaching percompound will be 5 to 65%, preferably 10 to 30%, the activator (mixture) will be 0.5 to 15%, preferably 3 to 15%, the molecular sieve zeolite will be 15 to 60%, preferably 25 to 55% and, when present, the inorganic builder salt will be 5 to 50%, preferably 5 to 25% of sodium carbonate, the sodium silicate content will be 1 to 15%, when present, preferably 5 to 10% and the inorganic filler salt content, preferably sodium sulfate, will be 5 to 50%, preferably 10 to 40%.

The various adjuvants present will normally total about 1 to 10%, with the individual adjuvants generally being within the range of 0.01 to 5%. The percentage of soil suspending agent, such as sodium carboxymethyl cellulose, may be from 0.5 to 2% while that of fluorescent brighteners or optical dyes may range from 0.01 to 2%. Of course, when any component is used in predominant proportion the percentages of other components of the product will be diminished accordingly. The percentage ranges given hereinabove for percompounds, activators, zeolites, builders, fillers and adjuvants also may apply to the bleach compositions (in which detergent is omitted or is present in very small percentage).

As was previously mentioned, the various embodiments of the bleaching and bleaching detergent compositions may be made by admixing powdered compounds but it is also within the invention to spray dry, spray cool, drum dry, co-size-reduce or otherwise produce the detergent-builder composition, with various suitable adjuvants also present, and then mix with the spray dried detergent-builder various of the powdered composition components. Thus, the particles of detergent-builder composition, preferably in globular or bead form, may be classified or sieved so that over 95% thereof passes through a No. 8 or No. 10 U.S. Standard Sieve Series sieve and less than 10%, preferably less than 5% and most preferably 0% passes through a No. 100 sieve. Except for the synthetic molecular sieve zeolite component, which may pass through the finer sieves mentioned, the rest of the product will normally pass through a No. 100 sieve and will fail to pass a No. 400 sieve, preferably passing through a No. 140 sieve and resting on a No. 325 sieve. The zeolite may be spray dried with such a product. The moisture contents of the bleach and detergent products will normally be low, usually in the range of 1 to 15%, preferably 1 to 10% and most preferably, in many cases, being 1 to 5%. The moisture contents of the invented products will preferably be limited to the waters of crystallization contained therein, with a possible excess that is rarely over 3% and preferably with no excess.

The bleaching and washing methods of this invention may be carried out at various pH's and concentrations but normally the pH will be in the range of 8 to 12, preferably 8.5 to 10.5 and most preferably it will be about 9 to 10. The concentration of invented bleaching composition in aqueous medium, such as water, will normally be from 0.01 to 0.2% and preferably will be 0.02 to 0.1% whereas on the bleaching composition is part of a detergent composition (usually being from 20 to 60% thereof, preferably 20 to 40% thereof), the total bleaching detergent composition concentration in the wash water will normally be from 0.05 to 2%, preferably being about 0.1 to 1%. Most preferably, such concentration will be about 0.15% in the United States and about 0.8% in European countries wherein high concentrations of detergent and low volumes of wash water have been employed in the conventional washing machines. Usually the laundry : wash water ratio will be from 0.03 to 0.2, preferably 0.04 to 0.1, e.g., 0.05 or 0.06 for United States laundering practices and about 1 to 5 times these ratios, e.g., 3 times, for European practices.

The present compositions are employed in the same manner as comparable products not containing the bleaching components. Thus, they may be used for cold, warm and hot water washing, usually in the temperature range of 10° to 70° C. Of course, as with all bleaching operations, care should be taken in the selection of materials to be bleached but apart from this general precaution, the present compositions may be employed with safety, giving effective bleaching, even with colored good, without seriously adversely affecting dye fastness. Excellent cold and warm water bleachings are obtainable, comparable to those from utilizations of the same proportions of peroxy compounds, such as sodium perborate, at or near the boil. When employing detergents, the washing times need not be changed from ordinary wash cycle times, usually being from 3 to 45 minutes, preferably being from 5 to 20 minutes in the United States and from 20 to 40 minutes according to European practice. Similar or corresponding times may also be employed with respect to other applications of the bleaching compositions, such as those previously mentioned, or the corresponding application times normally utilized for such products may be employed, e.g., 5 minutes to 3 hours for bleaching applications.

As a result of using the compositions and processes of this invention improved stabilities of the bleach and bleaching detergent compositions are obtained on storage and improved bleaching effects and combination washing-bleaching effects are obtained without the need to raise the aqueous medium employed to its boiling point. Also, any fugitive dyes not bleached by the oxidizing agent tend to be adsorbed by the ultrafine zeolite molecular sieve particles and thereby do not selectively deposit on fabrics being washed, changing their colors.

The activated bleaching composition and detergent-bleaches are especially good for removing or helping to remove a wide variety of difficult to remove stains from fabrics, including coffee, tea, wine and dye stains. Such desirable results are obtained without harming the fabrics being treated and without serious adverse effects on dyed fabrics, such as blue dyed polyester-cotten blends, which are often used as test fabrics to determine the safeness of bleaches. Such safe bleaching results are especially noted with the bleaching and bleaching-detergent compositions containing mixtures of activators of both the triazine and acyl types. Additionally, the oxygen releasing percompounds of this invention also possess desirable antimicrobial properties and such properties are aided by the presences of the activators molecular sieve zeolite and detergent components of the invented products. The detergent helps to wet the various surfaces to be treated with the bleach combination (percompound plus activators) and the molecular sieve zeolite furnishes nuclei for percompound decomposition in aqueous media (while when the product is a powder it helps to insulate and stabilize the bleaching compound mixture against decomposition) and also may adsorb or entrap in its crystalline or amorphous matrix viral and bacterial substances, assisting in the antimicrobial effects of the oxygen-releasing compounds, which may release oxygen at such nuclei. Thus, there is significant coaction between the various components of the bleaching and bleaching detergent compositions of this invention.

The invention will be further illustrated by the following examples. Unless otherwise indicated, all parts therein and in the specification are by weight and all temperatures are in ° C.

EXAMPLE 1

Using a laboratory washing machine, a tergotometer, turning at 100 revolutions per minutes (rpm), a mixed load of stained cotton fabric, blue-dyed cotton-polyester blend (50-50) fabric and clean white cotton fabric is agitated for 15 minutes in 1 liter of wash water at 60° C. containing a detergent composition of this invention. In such composition there is present 10% of sodium perborate tetrahydrate, 5% of BHADT activator, 5% of DDG activator, 40% of type 4A partially hydrated molecular sieve zeolite (Henkel & Cie. GmbH, about 20% moisture of hydration content, on a molecular sieve basis), 12% of sodium linear dodecyl benzene sulfonate, 10% of sodium carbonate (soda ash), 2% of sodium silicate ($Na_2O:SiO_2$ = 1:2.35) and 16% of sodium sulfate, anhydrous. The components of the detergent composition are initially of three different ranges of particle sizes, the sodium dodecylbenzene sulfonate, sodium silicate and 3/8 of the sodium sulfate being combined and in spray dried globular particulate form, of particle sizes in the 8 to 100 mesh range (95% passing through a No. 8 U.S. Standard Sieve Series sieve and resting on a No. 100 sieve), the molecular sieve zeolite being of 1 to 10 microns equivalent diameter, averaging about 6.4 to 8.3 microns and the other powders being in the range of 44 to 149 microns in diameter.

The component powders are mixed together gently but thoroughly in a Day horizontal mixer together and give grams of the free-flowing, storage-stable blend are added to the washing medium containing test fabrics to be washed and bleached. Alternatively, the spray dried mixture of detergent, silicate and some sulfate and the individual other components, in powdered forms, are separately added to the wash water. Whichever method of mixing the detergent-bleach with the wash water is employed, when the fabrics being treated are added before or after such addition results are the same, providing that care is taken to avoid depositing the powdered bleach on any wetted fabrics which are not being mixed adequately in the tergotometer.

After completion of the 15 minute wash the pH is 9.2 and the Gardner Color Difference Meter values ($\Delta Rd$) for the various test cloths are as follows: coffee/tea on cotton (7.4); red wine [EMPA 114] (30.3); sulfo dye [EMPA 115] (14.8); white cotton (−1.3); blue-dyed cotton-polyester blend (1.7) and $\Delta b$ for the blue-dyed cotton-polyester blend (−0.7). The differences in $\Delta Rd$ and $\Delta b$ indicate good stain removal effects vs. the test stains employed, no significantly objectionable diminution in whiteness in the white-cotton fabric and no objectionable discoloration of the blue fabric. Such results are obtained when the bleaching detergent composition is freshly made and used immediately and also when it is made and stored for one month and for six months under normal storage conditions at room temperture and in a barrier carton. Differences in bleaching effects are discernible, with the materials stored for longer periods of time being less active, but such materials are still satisfactory bleaching detergents, washing and bleaching effectively.

In a modification of this experiment instead of employing DDG as the supplementary activator with BHADT, TAG is used. Essentially the same results are obtained. When the concentration of the bleaching detergent is diminished to 0.15%, rather than the 0.5% disclosed, the bleaching effects are also diminished but the same types of effects may be noted. In all such cases, whether employing the greater or lesser concentration of bleaching detergent composition, no significantly objectionable damage to the fabrics is noted and any change of whiteness or "blueness" of the test fabrics is considered unobjectionable and is usually not apparent to the naked eye. When the washing temperature is lowered to 20° C. useful bleaching is obtainable but preferably the wash period is extended to 30 minutes for better washing and bleaching. Under such conditions good stain removal is obtained, like that previously reported in this example but to a lesser extent the white fabrics are not objectionably colored and the blue fabrics are not objectionably changed in appearance.

To further improve the washing effect of the bleaching detergent composition described there is included in the composition 4% (an equal quantity of sodium sulfate is replaced) of Neodol 45-11 (a higher fatty alcohol polyethoxyethanol wherein the higher alcohol is a straight chain saturated fatty alcohol of 14 to 15 carbon atoms and which contains 11 ethoxy groups per mol, including the alcoholic ethoxy group), with 2% being spray dried together with the built and filled synthetic anionic organic detergent crutcher mix and the other 2% being post-added to the detergent beads or the final bleaching detergent mix. In such formulas to improve anti-redeposition effects 1% of sodium carboxymethyl cellulose (replacing sodium sulfate) is included in the formula and is spray dried with the crutcher mix and 0.9% of mixed fluorescent brighteners (0.8% of Tinopal RBS and 0.1% of Phorwite BHC) is included to promote whitening of laundry washed. In such formulations the detergency is improved, stain removal is undimished, anti-redeposition effects are notable and the laundry appears brighter due to the presence of fluorescent brightner (which is not adversely affected by the percompound-activtor mixture).

In a further modification of the base experiment 0.5 g. of sodium perborate tetrahydrate, 0.25 g. of BHADT and 0.25 g. of DDG are employed with 2 g. of the molecular sieve zeolite, omitting the detergent, sodium silicate, sodium sulfate, sodium carbonate and adjuvants and in another case such composition with 0.5 g. of sodium carbonate (soda ash) and 0.5 g. of sodium sulfate (anhydrous) are employed. Both of these are bleaching compositions, are used primarily for that purpose and are designed to be employed either alone or in supplementation of a commercial heavy duty detergent. The materials bleached are the same as those previously described, as in the bleaching medium, the temperature thereof and the bleaching time. In some experiments agitation is employed and in others, after initial agitation to dissolve the various components, bleaching is quiescent. Better bleaching is obtained with agitation but in both cases the type of bleaching obtained for the bleaching detergent composition also results, even at 20° C. for 30 minutes.

A variety of different compositions within the invention, including sodium paraffin sulfonate wherein the paraffin is of 16 to 18 carbon atoms or including a mixture of equal parts of sodium tridecyl benzene sulfonate and sodium alpha-olefin sulfonate, the alpha-olefin sulfonate being of 14 to 16 carbon atoms, both instead of sodium dodecylbenzene sulfonate; including other molecular sieve zeolites, such as molecular seive zeolites 4A (Union Carbide), X and Y and those described in German Offenlegungsschrift 2,412,839, laid open on December 12, 1974; German Offenlegungsschrift 2,412,837, to which it is a patent of addition; German Offenlegungsschriften No. 2,412,838; and U.S. patent applications Ser. Nos. 359,293 (Corkill et al.), filed May 11, 1973; 450,266 (Corkill et al.), filed March 11, 1974; and 467,688 (Cheng), filed May 7, 1974, all of which are incorporated herein by reference. (Several of such applications disclose molecular sieve zeolites in detergent compositions and suggest that these may include perborate and various activators but the present preferred compositions are not taught). In some compositions half of the sodium sulfate and half or all of the sodium carbonate are replaced by pentasodium tripolyphosphate with good results (where possibly adverse ecological effects and government regulations do not have to be considered). Other of the previously mentioned triazine and acyl activators are employed and instead of sodium perborate tetrahydrate there are utilized equivalent (on an active oxygen basis) proportions of sodium percarbonate, other perborates (anhydrous and monohydrate) and sodium peroxysilicate. The proportions of the various components are changed over the ranges given, usually to be ±10, 20 and 30% with respect to the basic formula of this example and minor percentages of the described adjuvants are included, as mentioned. In all such cases the product washes and bleaches better (and safer) than comparable compositions wherein the percompound is used without activators or wherein the secondary (acyl) activator is not employed. This is so in laboratory and practical use laundry tests, using conventional tap or side loading washing machines and in tub soaking, washing and bleaching operations.

EXAMPLE 2

The basic experiment of Example 1 is repeated but instead of BHADT, DCT is employed. This activator is somewhat stronger than BHADT and when used without an acyl activator to diminish its effects may sometimes be slightly damaging to the color of the blue fabric but in the described composition, with acyl activator and molecular sieve zeolite, it is satisfactory. The pH at the end of the wash is 9.0 and the $\Delta Rd$ readings for coffee/tea, red wine, sulfo dye, white fabric and blue fabric are, respectively, 8.1; 33.5; 20.3; −0.8; and 1.6, with the $\Delta b$ for blue fabric being −0.5. Similar results are obtainable by substituting TAG for DDG. Essentially the same types of results are obtained by varying the alkyl, alkoxy and hologen groups of the triazine and acyl activators, as was taught earlier in the specification. Such effects also result when bleach compositions like those of Example 1, but in which DCT is employed instead of BHADT and in which TAG is utilized instead of DDG are used and when the various other variations of the compositions and processes of Example 1 are adapted to the compositions of this example.

EXAMPLE 3

The basic procedures of Examples 1 and 2 are repeated but instead of employing a mixture of triazine and acyl activators for the perborate only the individual triazine activators are present. Thus, for experiment (a)

it may be considered that the experiment of Example 1 is repeated without DDG (proportions of other materials are adjusted accordingly). In (b) the basic formula of Example 2 is also varied by omitting the DDG and replacing it with DCT. In Experiment (c) the DDG is omitted from the basic formula of Example 2 and the proportion of sodium perborate used (with the remaining activator, DCT) is cut to half.

The remaining table includes characteristics of the test cloths after washing them with compositions (a), (b) and (c), respectively, in accordance with the procedures described in Examples 1 and 2.

TABLE 1

| Composition | pH (End of wash) | ΔRd of Test Cloths | | | | | Δb |
|---|---|---|---|---|---|---|---|
| | | Coffee/tea | Red Wine | Sulfo Dye | White | Blue | Blue |
| a) | 9.7 | 5.3 | 20.3 | 11.0 | −2.2 | 1.4 | −0.7 |
| b) | 9.1 | 9.7 | 32.3 | 50.6 | −0.3 | 3.1 | 4.3 |
| c) | 9.6 | 9.2 | 29.2 | 36.4 | −0.4 | 2.2 | 2.3 |

As in Examples 1 and 2, when these compositions are varied to omit detergent and are used for bleaching alone similar results are obtained. The results indicate that formula (a) is the most satisfactory of the three (although it does not remove stains as well as the other formulas) because it does not objectionably bleach blue test fabric nor yellow blue fabric. However, when dyed fabrics are not being washed and color fastness is not of prime importance formulations like (b) and (c) supra bleach effectively and do not discolor white goods and therefore may be desirably employed.

In a comparative example, when no activator is utilized but the other components of the detergent compositons are present in the same quantities as in the previous formulas discussed, the bleaching, even in 60° C. water is not satisfactory. Thus, the pH at the end of the wash is 10.1, the $\Delta Rd$ readings for the test cloths are 2.3; 19.4; 4.8; −4.7; and 1.1 for the coffee/tea stained cloth, the red wine stained cloth, the sulfo dye stained cloth, the white fabric and the blue fabric, respectively; and $\Delta b$ for the blue fabric is −0.7. From such figures it is noted that the percompound by itself is a poor bleach for coffee/tea and sulfo dye stains and does not prevent yellowing or the development of off color in white fabrics.

Results similar to those reported above are obtained when other triazine whiteners are employed and the proportions of the various components of the detergent compositions and the bleaches are varied within the ranges described and ±10%; ±20; and ±30%.

The invention has been described with respect to various illustrations and examples thereof but is not to be limited to these since it is evident that one of skill in the art will be able to utilize substitutes and equivalents without departing from the spirit of the invention or the scope of the claims.

What is claimed is:

1. An activated percompound bleaching composition consisting essentially of, by weight, 5 to 75% of a bleaching percompound selected from the group consisting of inorganic percompounds and urea peroxide, 0.5 to 15% of an activator for such percompounds which activates the percompound to promote bleaching in an aqueous bleaching solution, said activator being selected from the group consisting of 2-[di(2-hydroxy-$C_1$–$C_5$ alkyl) amino]-4,6-dihalo-s-triazine, 2,4-di-$C_1$–$C_4$ alkoxy-6-halo-s-triazine and mixtures thereof, 5 to 75% of molecular sieve zeolite in the form of particles having a mean particle diameter in the range of 0.5 to about 12 microns which is selected from the group consisting of Type A, X, Y, L. mordenite and erionite zeolites, said zeolite containing from 1.5 to 36% by weight of water and having a cation selected from the group consisting of sodium, potassium, lithium, ammonium and hydrogen, 0 to 40% of a water-soluble synthetic organic detergent, 0 to 50% of a water-soluble alkali metal inorganic or organic builder salt and 0 to 50% of sodium sulfate or sodium chloride, said composition containing 0.1 to 1.5 parts of activator per part of percompound and 0.2 to 10 parts of molecular sieve zeolite per part of bleaching percompound and having a pH in the range of 8 to 12 in water.

2. A bleaching composition according to claim 1 wherein the proportions of bleaching percompound, activator and molecular sieve zeolite are 1:0.3 to 1.2:2 to 6 respectively and the percentages are 7 to 50% by weight and 20 to 60% by weight respectively.

3. A method of bleaching fibrous organic materials which comprises contacting them with an aqueous medium containing an activated percompound bleaching composition of claim 1.

4. A method of bleaching according to claim 3 wherein the bleaching composition is that of claim 2.

5. A bleaching composition according to claim 1 in which there is present with an activator described in said claim an activator selected from the group consisting of di-$C_2C_5$ alkanoyl di-$C_1C_4$ alkyl glyoxime, tetra-$C_2C_5$ alkanoyl glycoluril and mixtures thereof.

6. A bleaching compositon according to claim 5 wherein the percompound is selected from the group consisting of alkali metal perborate and alkali metal percarbonate, the activator mixture is a mixture of 2-[bis(2-hydroxyethyl)amino]-4,6-dichloro-s-triazine and diacetyl dimethylglyoxime and the molecular sieve zeolite is selected from the group consisting of types A, X and Y synthetic molecular sieve zeolites.

7. A bleaching composition according to claim 5 wherein the percompound is selected from the group consisting of alkali metal perborate and alkali metal percarbonate, the activator mixture is a mixture of 2,4-dimethoxy-6-chloro-s-triazine and diacetyl dimethylglyoxime and the molecular sieve is selected from the group consisting of types A, X and Y synthetic molecular sieve zeolites.

8. A bleaching composition according to claim 6 wherein the bleaching compound is sodium perborate tetrahydrate, the molecular sieve zeolite is a hydrated type A synthetic molecular sieve zeolite containing 20 to 28.5% water and the ratio of activators in the mixture thereof is in the range of 1:4 to 4:1.

9. A bleaching composition according to claim 7 wherein the bleaching compound is sodium perborate tetrahydrate, the molecular sieve zeolite is a hydrated type A synthetic molecular sieve zeolite containing 20 to 28.5% water and the ratio of activators in the mixture thereof is in the range of 1:4 to 4:1.

10. A bleaching composition according to claim 8 wherein the proportions of sodium perborate tetrahydrate, 2-[bis(2-hydroxyethyl)amino]-4,6-dichloro-s-triazine and diacetyl dimethylglyoxime mixture and hydrated type A synthetic molecular sieve zeolite are 1:0.3 to 1.2:2 to 6, respectively, with the proportion of sodium perborate tetrahydrate being from 7 to 50% and the proportion of hydrated type A synthetic molecular sieve zeolite being from 20 to 60%.

11. A bleaching composition according to claim 9 wherein the proportions of sodium perborate tetrahydrate, 2,4-dimethoxy-6-chloro-s-triazine and diacetyl dimethylglyoxime mixture and hydrated type A synthetic molecular sieve zeolite are 1:0.3 to 1.2:2 to 6, respectively, with the proportion of sodium perborate tetrahydrate being from 7 to 50% and the proportion of hydrated type A synthetic molecular sieve zeolite being from 20 to 60%.

12. A bleaching composition according to claim 10 which contains from 5 to 25% of sodium carbonate and from 5 to 50% of sodium sulfate.

13. A bleaching composition according to claim 11 which contains from 5 to 25% of sodium carbonate and from 5 to 50% of sodium sulfate.

14. A bleaching detergent composition consisting essentially of, by weight, 5 to 40% of a water-soluble synthetic organic detergent, 5 to 75% of a bleaching percompound selected from the group consisting of inorganic percompounds and urea peroxide, 0.5 to 15% of an activator for such percompounds which activates the percompound to promote bleaching in an aqueous bleaching solution, said activator being selected from the group consisting of 2-[di(2-hydroxy-$C_1$–$C_5$ alkyl-)amino]-4,6dihalo-s-triazine, 2,4-di-$C_1$–$C_4$ alkoxy-6-halo-s-triazine and mixtures thereof, 5 to 75% of molecular sieve zeolite in the form of particles having a mean particle diameter in the range of 0.5 to about 12 microns which is selected from the group consisting of Type A, X, Y, L mordenite and erionite zeolites, said zeolite containing from 1.5 to 36% by weight of water and having a cation selected from the group consisting if sodium, potassium, lithium, ammonium and hydrogen, 0 to 50% of a water-soluble alkali metal inorganic or organic builder salt and 0 to 50% of sodium sulfate or sodium chloride, said composition containing 0.1 to 2 parts of synthetic detergent per part of percompound, 0.1 to 1.5 parts of activator per part of percompound and 0.2 to 10 parts of molecular sieve zeolite per part of bleaching percompound and having a pH in the range of 8 to 12 in water.

15. A method of washing and bleaching laundry which comprises contacting said laundry with a bleaching detergent composition of claim 14.

16. A method according to claim 15 wherein the bleaching detergent composition is that of claim 17.

17. A detergent composition according to claim 14 in which there is present with the activator described in said claim an activator selected from the group consisting of di-$C_2C_5$ alknoyl di-$C_1C_4$ alkyl glyoxime, tetra-$C_2C_5$ alkanoyl glycoluril and mixtures thereof.

18. A detergent composition according to claim 17 comprising from 5 to 40% of a water-soluble synthetic organic detergent selected from the group consisting of anionic and nonionic detergents and mixtures thereof, 5 to 65% of bleaching percompound, 0.5 to 15% of activator mixture, 15 to 60% of molecular sieve zeolite and 5 to 50% of inorganic builder salt.

19. A detergent composition according to claim 18 wherein the synthetic organic detergent is a synthetic anionic sulfonated or sulfated detergent, the bleaching percompound is sodium perborate tetrahydrate, the activator mixture is a mixture of 2-[bis(2-hydroxyethyl-)amino]-4,6-dichloro-s-triazine and diacetly dimethyl glyoxime in 1:4 to 4:1 ratio, the molecular sieve zeolite is a hydrated type A synthetic molecular sieve zeolite containing 20 to 28.5% water and the builder salt is sodium carbonate.

20. A detergent composition according to claim 18 wherein the synthetic organic detergent is a synthetic anionic sulfonated or sulfated detergent, the bleaching percompound is sodium perborate tetrahydrate, the activator mixture is a mixture of 2,4-dimethoxy-6-chloro-s-triazine and diacetyl dimethyl glyoxime in 1:4 to 4:1 ratio, the molecular sieve zeolite is a hydrated type A synthetic molecular sieve zeolite containing 20 to 28.5% water and the builder salt is sodium carbonate.

21. A phosphate-free heavy duty detergent composition according to claim 19 wherein the synthetic organic detergent is sodium higher linear alkylbenzene sulfonate wherein the alkyl is of 12 to 14 carbon atoms and the proportion thereof present in the composition is from 10 to 25%, the proportion of sodium perborate tetrahydrate is from 10 to 30%, the proportion of activator mixture is from 3 to 15%, the proportion of hydrated type A molecular sieve zeolite is from 25 to 55%, the proportion of sodium carbonate is from 5 to 25%, the ratio of activators is in the range of 1:2 to 2:1 and there is present from 1 to 15% of sodium silicate of $Na_2O:SiO_2$ ratio of about 1:2.35 and 10 to 40% of sodium sulfate.

22. A phosphate-free heavy duty detergent composition according to claim 20 wherein the synthetic organic detergent is sodium higher linear alkylbenzene sulfonate wherein the alkyl is of 12 to 14 carbon atoms and the proportion thereof present in the composition is from 10 to 25%, the proportion of sodium perborate tetrahydrate is from 10 to 30%, the proportion of activator mixture is from 3 to 15%, the proportion of hydrated type A molecular sieve zeolite is from 25 to 55%, the proportion of sodium carbonate is from 5 to 25%, the ratio of activators is in the range of 1:2 to 2:1 and there is present from 1 to 15% of sodium silicate of $Na_2O:SiO_2$ ratio of about 1:2.35 and 10 to 40% of sodium sulfate.

* * * * *

UNITED STATES PATENT AND TRADEMARK OFFICE

CERTIFICATE OF CORRECTION

PATENT NO. : 4,055,505

DATED : October 25, 1977

INVENTOR(S) : Frederick W. Gray

It is certified that error appears in the above-identified patent and that said Letters Patent are hereby corrected as shown below:

In Column 2, line 56 change:

"triazone"to --triazine--

In Column 5, line 68 change:

"in" to --is--

In Column 6, line 59 change:

"bleeching" to --bleaching--

In Column 7, line 17 change:

" molecular" to -- molecule --.

UNITED STATES PATENT AND TRADEMARK OFFICE

CERTIFICATE OF CORRECTION

PATENT NO. : 4,055,505

DATED : October 25, 1977

INVENTOR(S) : Frederick W. Gray

It is certified that error appears in the above-identified patent and that said Letters Patent are hereby corrected as shown below:

In Column 9, line 21 change:

"may be used)" to -- may also be used)--

In Column 10, line 62 change:

"Wheras on the" to --Whereas when the--

In Column 11, line 17 change:

"good" to --goods--

In Column 12, line 39 change:

"give grams of" to --five grams of--

In Column 13, line 45 change:

"activtor" to --activator--

In Column 13, line 58 change:

"as in the bleaching" to -as is the bleaching --

UNITED STATES PATENT AND TRADEMARK OFFICE

CERTIFICATE OF CORRECTION

PATENT NO. : 4,055,505

DATED : October 25, 1977

INVENTOR(S) : Frederick W. Gray

It is certified that error appears in the above-identified patent and that said Letters Patent are hereby corrected as shown below:

In Column 14, line 55 change:

"hologen" to --halogen--

In Column 16, line 37 change:

"di-$C_2C_5$" to --di-$C_2$-$C_5$--

In Column 16, line 37 change:

"di-$C_1C_4$" to --di-$C_1$-$C_4$--

In Column 16, line 38 change:

"$C_2C_5$" to --$C_2$-$C_5$--

In Column 17, line 33 change:

"6dihalo" to --6-dihalo--

In Column 18, line 1 change:

"di-$C_2C_5$" to --di-$C_2$-$C_5$--

UNITED STATES PATENT AND TRADEMARK OFFICE

CERTIFICATE OF CORRECTION

PATENT NO. : 4,055,505

DATED : October 25, 1977

INVENTOR(S) : Frederick W. Gray

It is certified that error appears in the above-identified patent and that said Letters Patent are hereby corrected as shown below:

In Column 18, line 1 change:

"di-$C_1C_4$" to --di-$C_1$-$C_4$--

In Column 18, line 2 change:

"$C_2C_5$" to --$C_2$-$C_5$--

In Column 18, line 15 change:

"diacetly" to --diacetyl--

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*